US009711163B2

(12) United States Patent
Rutherford

(10) Patent No.: US 9,711,163 B2
(45) Date of Patent: Jul. 18, 2017

(54) BI-DIRECTIONAL IN-LINE ACTIVE AUDIO FILTER

(71) Applicant: B/E AEROSPACE, INC., Wellington, FL (US)

(72) Inventor: Brian Rutherford, Stilwell, KS (US)

(73) Assignee: B/E Aerospace, Inc., Wellington, FL (US)

( * ) Notice: Subject to any disclaimer, the term of this patent is extended or adjusted under 35 U.S.C. 154(b) by 0 days.

(21) Appl. No.: 14/828,139

(22) Filed: Aug. 17, 2015

(65) Prior Publication Data

US 2016/0055860 A1 Feb. 25, 2016

Related U.S. Application Data

(60) Provisional application No. 62/040,383, filed on Aug. 21, 2014.

(51) Int. Cl.

| | |
|---|---|
| ***G10L 21/0208*** | (2013.01) |
| ***H04R 1/08*** | (2006.01) |
| ***H04R 3/00*** | (2006.01) |
| ***H04R 3/04*** | (2006.01) |
| *A62B 18/08* | (2006.01) |
| *H04R 1/02* | (2006.01) |

(52) U.S. Cl.

CPC ..... *G10L 21/0208* (2013.01); *H04R 1/08* (2013.01); *H04R 3/00* (2013.01); *H04R 3/04* (2013.01); *A62B 18/08* (2013.01); *H04R 1/028* (2013.01); *H04R 2201/023* (2013.01); *H04R 2410/07* (2013.01)

(58) Field of Classification Search

None

See application file for complete search history.

(56) References Cited

U.S. PATENT DOCUMENTS

| | | | | |
|---|---|---|---|---|
| 7,010,136 | B1 * | 3/2006 | Roberts | H04R 25/502 381/317 |
| 2012/0321106 | A1 | 12/2012 | Chang | |
| 2013/0070940 | A1 | 3/2013 | Khenkin et al. | |
| 2013/0156246 | A1 * | 6/2013 | Menyhart | H04R 1/04 381/367 |

OTHER PUBLICATIONS

International Search Report, Oct. 28, 2015, 4 pages.

* cited by examiner

*Primary Examiner* — Paul Huber

(74) *Attorney, Agent, or Firm* — Gardella Grace P.A.

(57) ABSTRACT

An audio filter for a breathing apparatus uses active filtering in a multi-wire system where one or more electrical conductors contain bi-directional signals using multiple stages of active isolation to separate direct current (DC) power, which is then used to bias an active filtering element. Using active signal conditioning or processing elements, the audio filter directionally separates the power and audio components to allow active conditioning or processing of the audio signal.

11 Claims, 4 Drawing Sheets

BI-DIRECTIONAL IN-LINE ACTIVE AUDIO FILTER

CROSS-REFERENCES TO RELATED APPLICATIONS

This application is based upon and claims priority from U.S. Provisional Application No. 62/040,383, filed Aug. 21, 2014, the contents of which are incorporated by reference in its entirety.

BACKGROUND

Emergency breathing apparatus are used in situations where fire, smoke, dust and debris, or other impediments prevent normal breathing during a rescue. These breathing apparatus provide oxygen to the user and prevent smoke or other pollutants from entering the device. For safety reasons, many of these devices also include two-way communication devices to assist in rescue or coordination of efforts to fight a fire, etc. Two way communication devices typically comprise microphones powered by direct current batteries, where the voltage is used to amplify a voice for transmission via a transceiver to a remote receiver. An issue that plagues communication in emergency situations is that the microphone picks up and amplifies the heavy breathing and pronounced movement of air, leading to a transmission that is difficult to interpret and makes critical communication challenging.

FIG. 1 depicts a prior art two wire system for communicating audio signals. In this circuit, a first wire carries both the audio signal and a direct current. A second wire is provided that serves as a ground/return path. The problem with this circuit is that it is impossible to isolate the audio signal and filter it effectively without interrupting the power signal. This results in a noisy audio signal that has poor quality and can lead to dangerous repercussions when communication is critical in an emergency situation. As constructed, the microphone tends to be very sensitive and picks up every minute sound while active. During normal modes of oxygen mask operation, the microphone is active when the wearer is not inhaling (and thus active for speaking) and not active when the wearer inhales. However, during certain modes of oxygen mask operation the microphone is continually active, and the continuous sounds of air rushing over the microphone are captured. This continuous unwanted "noise" is obtrusive and severally impedes effective communication.

SUMMARY OF THE INVENTION

The present invention addresses the foregoing by establishing a microphone circuit that can filter out higher frequency audible noise created by air rushing over an oxygen mask microphone without a disruption of the DC power signal.

The audio filter of the present invention may be used for both commercial and consumer products that utilize dual-wire bidirectional audio applications. Note that the term "dual" is not intended to be limiting, and that more than two wires can also be used. The invention channels active filtering in a multi-wire system where one or more electrical conductors contain bi-directional signals using two stages of active isolation (in certain cases, specifically created with op-amps) to separate direct current (DC) power, which is then used to bias active filtering elements. Using active signal conditioning or processing elements, the present invention directionally separates the DC and AC components to allow active conditioning or processing of the AC signal. The present invention can be applied to any application where it is advantageous to actively condition an AC signal that is present on the same wire as a DC voltage.

These features as well as other advantages will best be understood with reference to the following figures in conjunction with the detailed description of the best mode for carrying out the invention set forth below.

DETAILED DESCRIPTION OF THE PREFERRED EMBODIMENTS

Figure 1:
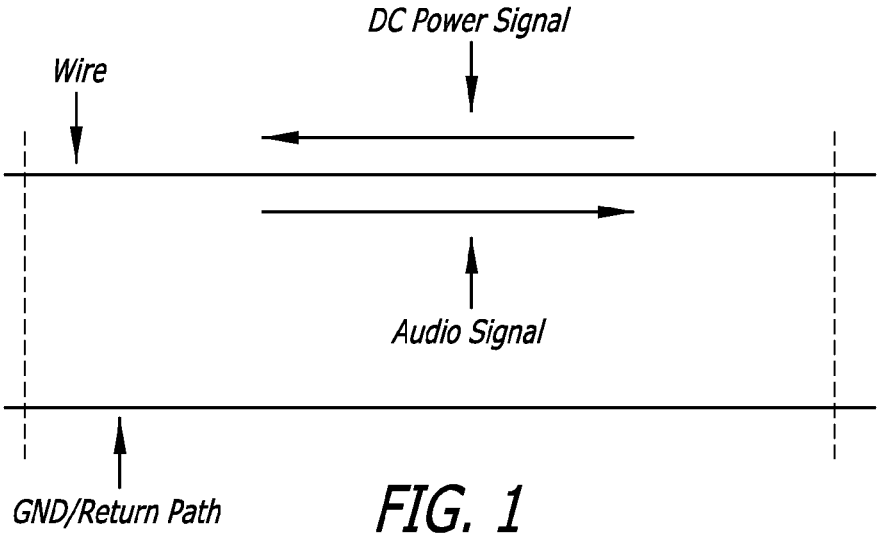
FIG. 1 (Prior Art)
FIG. 1 is a schematic of the prior art dual wire system.

FIG. 1 illustrates a prior art two wire system for communicating audio signals where a first wire carries both the audio signal and a direct current, and the second wire is a ground/return path. In this situation, it is impossible to isolate the signal and filter it effectively without interrupting the power signal. This leads to unfiltered or poorly filtered audio signals and the opportunity for ineffective communication.

Figure 2:
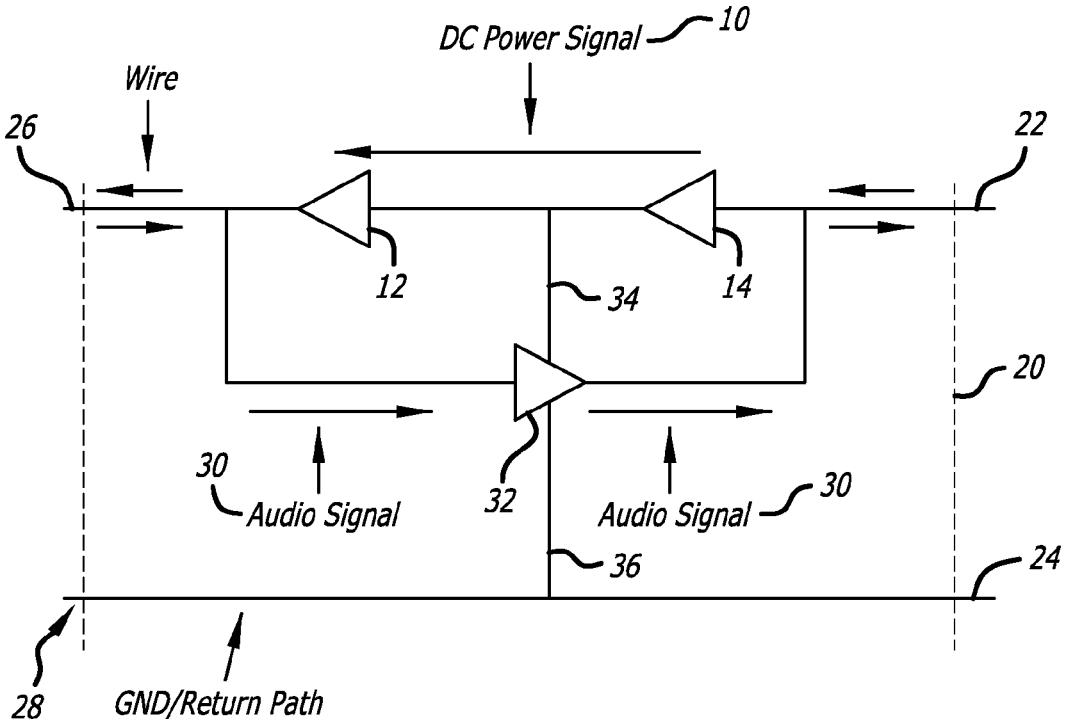
FIG. 2 is a schematic of a multi-wire system with active filtering.

FIG. 2 illustrates a solution to the problem of FIG. 1, where a second path for the audio signal is established in parallel with the power signal, such that the audio signal can be isolated and filtered or otherwise processed without disturbing the accompanying power signal on the same path. The filtering of the audio signal takes place in an isolated zone where the audio is separated from the power signal. The filter 20 is represented by dashed lines and receives the dual wire inputs as with the example of FIG. 1, namely the power wire 22 and the ground wire 24. The output consists of the power wire 26 and the ground/return wire 28. Within the filter 20, the DC power signal is represented by arrow 10 and traveling in a first direction. The DC power signal 10 has a path that can include power filters 12, 14 to process the power supply if necessary. Within the filter 20, an audio signal represented by arrows 30 are parallel to the DC power signal 10, and can include an audio filter 32 powered by the DC power signal 10 via connection 34. That is, the DC power signal can be used to drive the audio filter 32 although separated from the power signal path. The DC power path 10 and the audio signal path 30 are connected to the ground/return wire 24,28 at connection 36.

Figure 3:
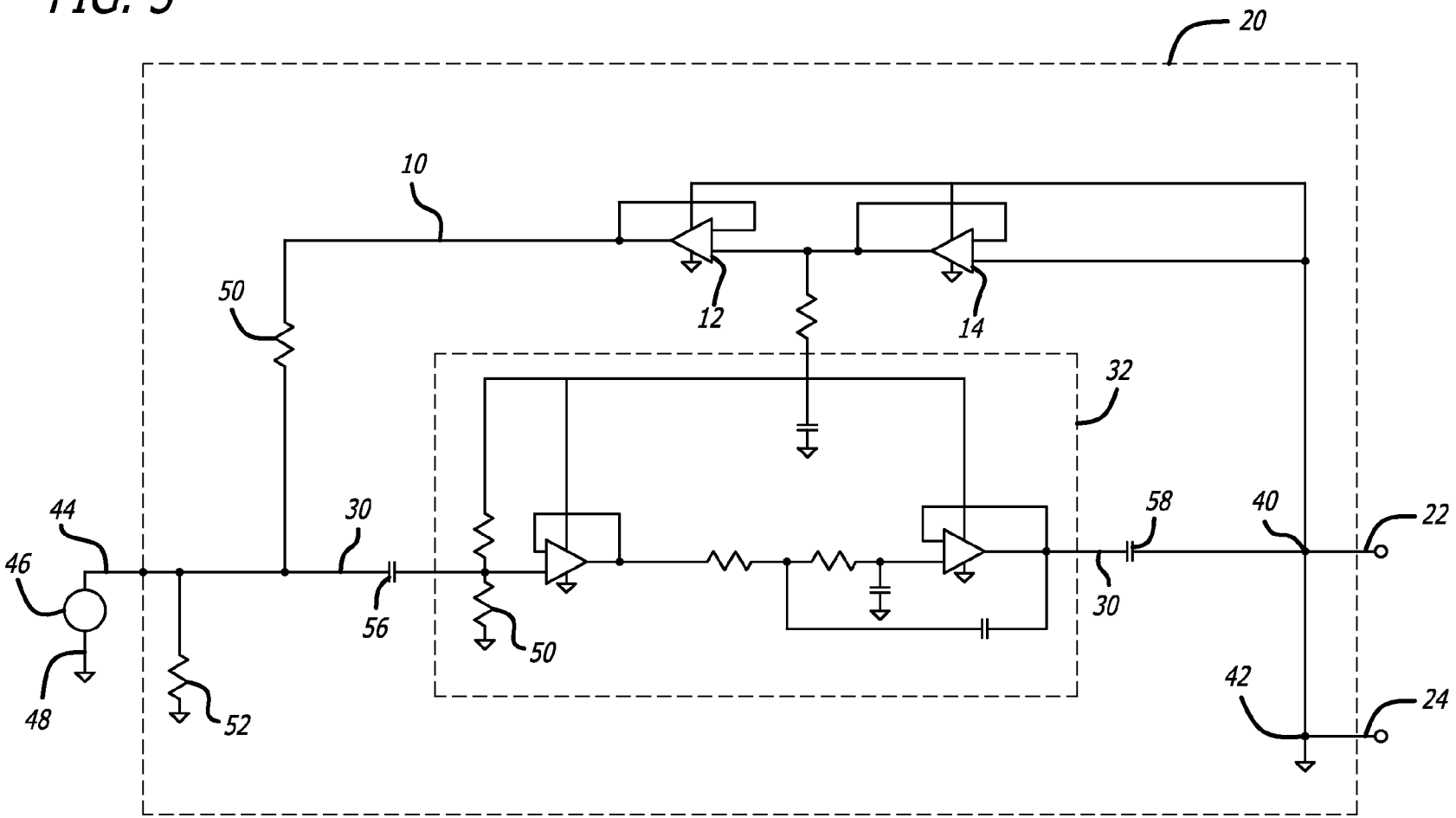
FIG. 3 is an exemplary detailed circuit diagram of a first embodiment of an audio filter of the present invention.

FIG. 3 illustrates an exemplary detailed circuit diagram of an audio filter 20 of the present invention. The DC supply wire 22 and the ground/return wire 24 are connected to the ground 42 and the audio signal output 40 of the filter. The input is the wire 44 from the mask microphone 46, which should also be connected to the ground 48. The filter 20 establishes a first path 10 that includes at least a pair of filters 12, 14 and provides a flow of current (the DC power path 10) along an upper path. A tunable resistor 50 controls the current through the DC power path. Resistor 52 precedes the division of the DC power and audio paths, where capacitors 56 and 58 regulate the current through the audio path 30. A tunable filter 32 is placed in the path of the audio signal to filter out noise and unwanted signal frequencies. The tunable filter 32 allows only the optimal frequencies to be passed through the filter while undesirable frequencies are blocked by the filter 32, as determined by the circumstances. Capacitors 56 and 58 are tunable as well to improve the output and adjust the noise to output signal ratio.

Figure 4:
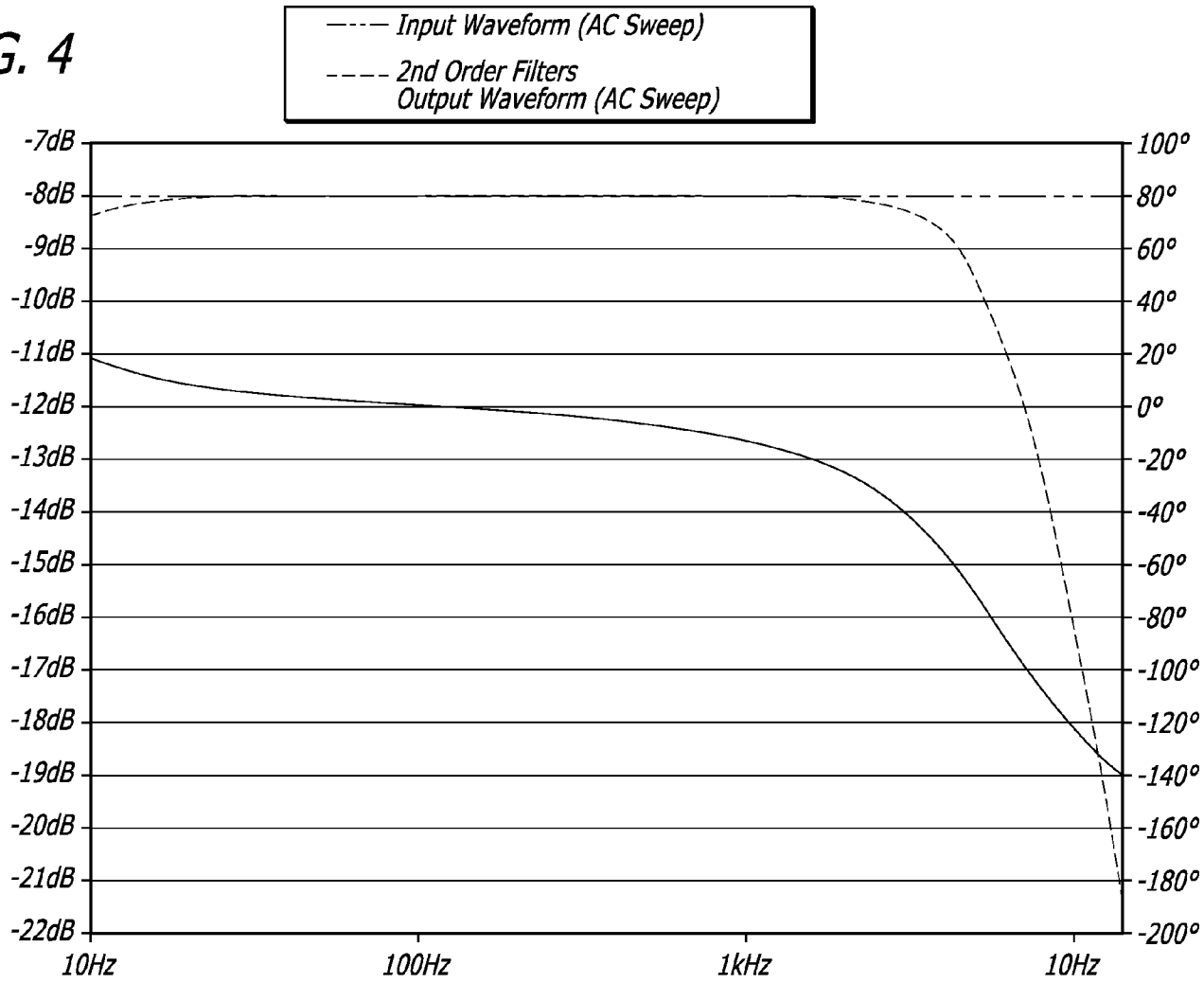
FIG. 4 is a graph comparing an unfiltered and filtered audio response using the present invention.

FIG. 4 is a graph illustrating a comparison of the filtered versus unfiltered audio signal plot as a function of signal frequency. As can be seen, the reference wave form is steady at −8 dB, and the phase data varies as shown between 20 degrees and −140 degrees. The resultant audio signal shows a high filtering at frequencies above 2 KHz, corresponding with a second order filtering. In this example, the processing of the audio signal is low-pass filtered with a cut-off frequency near 5 kHz. The amplitude roll-off of this filter is consistent with a first order filter. Also, while FIG. 4 denotes a second order filter, the plot only demonstrates a 6 dB/octave of roll-off, as one would expect with a single order filter. In general, the amplitude roll-off is consistent with that of a low-pass filter.

The filter 20 may utilize Op-Amps as the active elements. However, it would also be possible to establish the filter using transistors connected in a diode configuration. For example, using a BJT the base and collector would be connected together, and the emitter would be the active device output; for a FET, the gate and drain would be connected together and the source would be the active device output. This is an example of other active device configurations that could be used; it is understood that there are other active device configurations possible.

Figure 5:
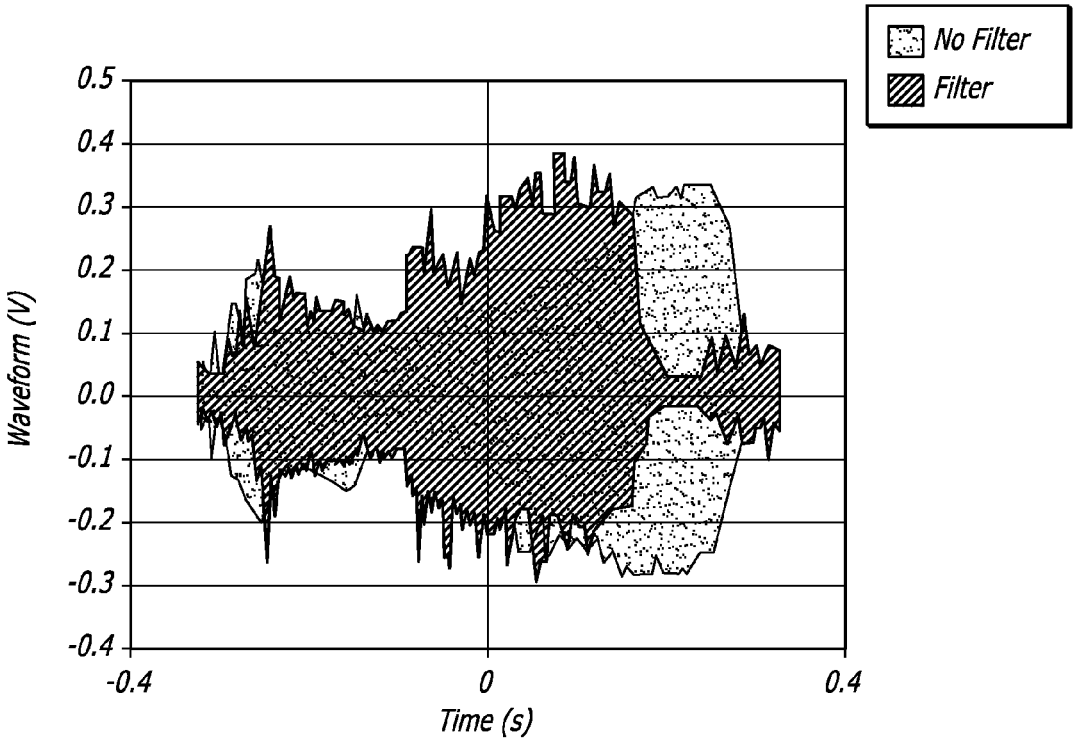
FIG. 5 is a plot of a speaking waveform versus time comparison of the present invention.

FIG. 5 depicts a graph of a waveform plot versus time illustrating the effect of the present invention using speech as the input. It can be seen that the unfiltered portion of the output includes a large amount of unwanted noise, whereas the filtered output effectively eliminates the unwanted noise, thereby better enabling communication to occur. That is, the speech waveform suffers minimal degradation using the present invention and the filtered and unfiltered speech waveforms are nearly identical. This results in the desired signal having zero to minimal degradation.

Figure 6:
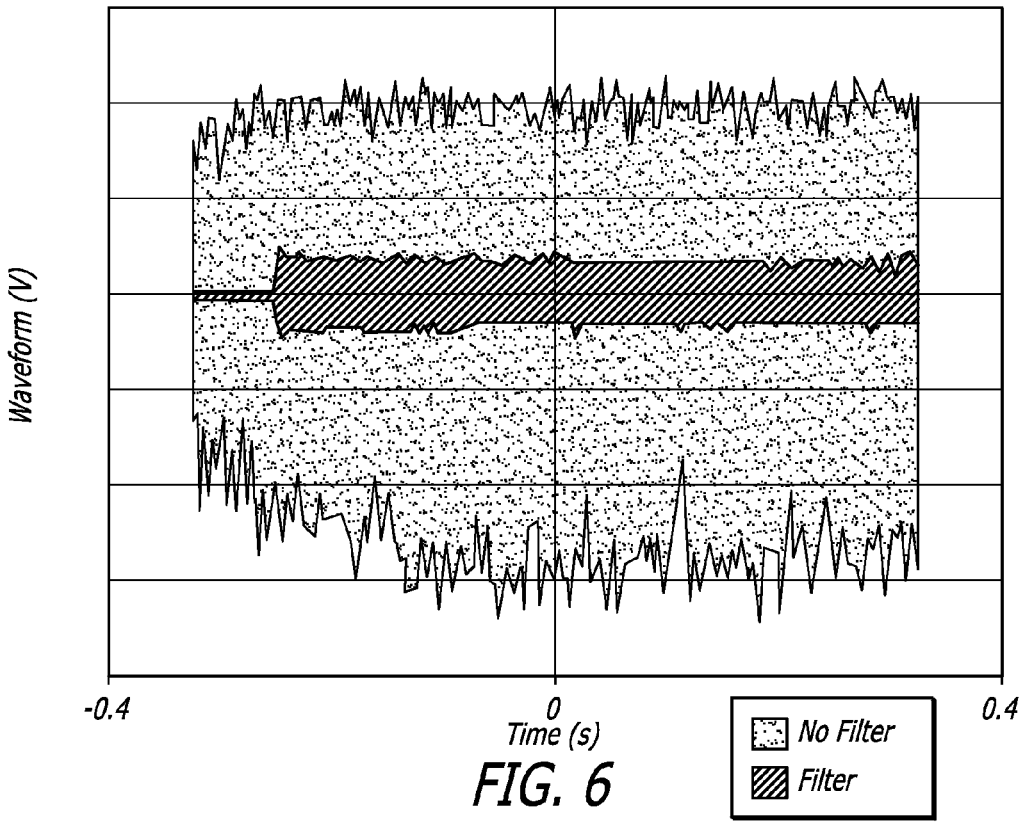
FIG. 6 is a plot of a breathing waveform versus time comparison of the present invention.

FIG. 6 illustrates a graph of an emergency breathing waveform (as opposed to speech waveform) versus time. The graph of FIG. 6 shows how significantly the amplitude of the breathing contribution may be eliminated by the filter by the present invention. In situations where noise from breathing can overwhelm the audio signal, the repression of the audio signal due to the breathing contribution demonstrates the benefit of the present invention. The pronounced reduction in noise associated with the user's breathing paves the way for easier and better communication by the user and the listener. The graphs of FIGS. 5 and 6 show that the filter of the present invention can transmit an audio signal where the speech portion of the audio signal is largely intact while the breathing contribution of the audio is significantly filtered, preserving the communication portion of the audio and significantly reducing noise.

In this circuit, it should be understood that the "filter" represents an active signal conditioning circuit which requires DC power, where this power is transmitted over the same wire as the active signal. Moreover, the invention doesn't have to be limited to single wire bidirectional DC power and AC signals. Rather, the AC signal could be traveling the same direction as the DC power. The invention surrounds the separation of the DC and AC components so that signal conditioning/processing may be performed on either component. Thus, while the foregoing descriptions have been made with reference to a breathing apparatus microphone, the invention is not so limited and may take many forms and applications.

I claim:

1. An audio filter for bi-directional signals, the filter comprising:

a DC power signal output;

a ground/return output;

a microphone input having a power signal and an audio signal;

a split of the microphone input using active isolation into a first path for the power signal and a second path for the audio signal;

an active supply element on the first path for the power signal, the active supply element comprising a first active power amplifier element and a second active power amplifier element, each operatively biased by the DC power signal, wherein an output of the first active power element supplies the power signal to an input of the second active power element at an intermediate power node; and an active filtering element on the second path for the audio signal and biased from the intermediate power node by the power signal, where the active filtering element is coupled to the first path for the power signal.

2. The audio filter of claim 1, wherein the active isolation is established using op-amps.

3. The audio filter of claim 1, wherein the active isolation is established using transistors in a diode configuration.

4. The audio filter of claim 1, wherein the active filtering element can be tuned to filter out breathing noise while passing through speech signals.

5. The audio filter of claim 1, wherein the microphone input is part of a breathing apparatus.

6. The audio filter of claim 1, wherein the power signal travels in a first direction and the audio signal travels in an opposite direction.

7. The audio filter of claim 1, wherein the power signal is a direct current signal and the audio signal is an alternating current signal.

8. The audio filter of claim 1, wherein the audio filter is part of an inline configuration connected to the microphone input.

9. The audio filter of claim 1, wherein the active filtering element relies on tunable resistors to allow optimal frequencies to be passed through the filter.

10. The audio filter of claim 1, wherein first and second capacitors immediately precede and follow the active filtering element.

11. The audio filter of claim 1, wherein the active filtering element achieves second order filtering of the audio signal.

* * * * *